US005174366A

United States Patent [19]

Nagakura et al.

[11] Patent Number: 5,174,366

[45] Date of Patent: Dec. 29, 1992

[54] BENDABLE COOLING FIN AND HEAT-EXCHANGER WITH A BENT COOLING FIN BLOCK

[75] Inventors: Susumu Nagakura; Yoshiaki Nagaoka; Kenzi Iizuka, all of Shizuoka, Japan

[73] Assignee: Kabushiki Kaisha Toshiba, Kanagawa, Japan

[21] Appl. No.: 787,667

[22] Filed: Nov. 4, 1991

[30] Foreign Application Priority Data

Nov. 8, 1990 [JP] Japan ..... 2-303269

[51] Int. Cl.[5] ..... F28F 1/32

[52] U.S. Cl. ..... 165/77; 165/151; 29/890.03

[58] Field of Search ..... 165/76, 77, 151, 182; 29/890.03; 72/379.2

[56] References Cited

U.S. PATENT DOCUMENTS

| | | | |
|---|---|---|---|
| 3,089,225 | 5/1963 | Heuer | 29/890.03 X |
| 4,546,820 | 10/1985 | Whipple | 165/77 |
| 4,876,778 | 10/1989 | Hagihara et al. | 29/157.3 A |

FOREIGN PATENT DOCUMENTS

| | | | |
|---|---|---|---|
| 60-174497 | 9/1985 | Japan | 165/77 |
| 2-106632 | 4/1990 | Japan | 165/182 |
| 1577978 | 10/1980 | United Kingdom . | |
| 1593521 | 7/1981 | United Kingdom . | |
| 2223330A | 4/1990 | United Kingdom . | |

*Primary Examiner*—Allen J. Flanigan
*Attorney, Agent, or Firm*—Philip M. Shaw, Jr.

[57] ABSTRACT

A cooling fin, used in a heat-exchanger, which includes a breakable line section extending from one side of the cooling fin plate to a substantially middle portion of the plate in a direction perpendicular to the elongated direction of the plate and a substantially V-shaped notch formed at a portion of the other side of the plate corresponding to the extended end of the breakable line section. The cooling fins are stacked in prescribed numbers to make a cooling fin block. The breakable line section includes a perforated line and is broken when one part of the cooling fin block in the elongated direction is bent against the other part of the block along the breakable line section.

12 Claims, 3 Drawing Sheets

BENDABLE COOLING FIN AND HEAT-EXCHANGER WITH A BENT COOLING FIN BLOCK

BACKGROUND OF THE INVENTION

1. Field of the invention

The present invention relates, in general, to cooling fins. In particular, the invention relates to a bendable cooling fin which is stacked together in prescribed numbers and is used in the heat-exchanger of an air conditioning apparatus.

2. Description of the related art

A compact and high efficiency heat-exchanger has been long desired in an air conditioning apparatus. Such a heat-exchanger has heretofore used stacked cooling fins (hereinafter referred as a cooling fin block) through which a plurality of refrigerant flow pipes penetrate to exchange heat between refrigerant flowing through the refrigerant flow pipes and an external atmosphere through the cooling fin block. To accommodate the external shape of the air conditioning housing, the upper side of the cooling fin block is bent against the lower side thereof at a prescribed angle. In particular, such a heat-exchanger having a bent cooling fin block is used in a compact type air conditioner employed in an automobile, which has a relatively small mechanical compartment. Also, a heat-exchanger having a bent cooling fin block is used in a household air conditioner including an internal unit whose height is relatively small, as compared with its width.

Japanese laid-open patent (Kokai) 2-106228 discloses a method for manufacturing a heat-exchanger with a cooling fin block. The method disclosed in this laid-open patent includes four processes.

A first process is a preparation process in which a hole and a plurality of notches are formed in a thin plate (cooling fin) so that at least two connecting portions are left in the plate in the direction perpendicular to the longitudinal direction of the plate. A prescribed number of such plates are stacked one on top of another to make a cooling fin block.

A second process is a cutting process wherein the stacked plates (cooling fin block) are cut from one of the plurality of notches to the hole after the heat-exchanger is assembled by penetrating a plurality of refrigerant flow pipes through the cooling fin block.

A third process is a bending process in which the upper portion of the cooling fin block is bent at a prescribed angle.

A fourth process is a connecting process in which the refrigerant flow pipes at the upper and lower portions of the cooling fin block are connected with a connecting pipe.

In the above-described manufacturing method, four processes are required to make the heat-exchanger with a bent cooling fin block. In particular, in the cutting process, a keen blade is used to cut the connecting portion from one of the notches to the hole. It is necessary to adjust the direction of the blade so as to accurately aim at the hole. Thus, a practiced work is required when the cutting process is carried out.

SUMMARY OF THE INVENTION

Accordingly, it is an object of the present invention to provide an improved cooling fin, which is stacked and is bent, made by reduced manufacturing processes, as compared with that of a conventional cooling fin.

It is another object of the invention to provide an improved method for manufacturing a heat-exchanger with a bent cooling fin block.

According to one aspect of the present invention, a cooling fin includes an elongated thin plate, a plurality of holes in the plate, a breakable line section extending from one side of the plate to a substantially middle portion of the plate in a direction perpendicular to the elongated direction of the plate, and a substantially V-shaped notch formed at a portion of the other side of the plate corresponding to the extended end of the breakable line section. The breakable line section is broken when one part of the plate in the elongated direction is bent against the other part of the plate along the breakable line section.

The breakable line section may include a second substantially V-shaped notch formed at the one side of the plate. The breakable line section may also include a perforated line portion extending from the second substantially V-shaped notch in a direction perpendicular to the elongated direction of the plate. The breakable line section may further include a previously cut line portion extending from the end of the perforated line portion toward the other side of the plate in an inclination angle.

According to another aspect of the present invention, a method for manufacturing a heat-exchanger having a bent cooling fin block includes the steps of:

preparing a cooling fin plate having a breakable line section extending from the one side of the plate toward the other side in the direction perpendicular to the elongated direction, a substantially V-shaped notch formed at the other side of the plate and a plurality of holes;

stacking the cooling fin plate at a prescribed numbers to make a cooling fin block;

inserting a refrigerant flow pipe into the cooling fin block through the plurality of holes;

breaking the breakable line section from the one side of the cooling fin block to bend one part of the cooling fin block against the other part at a prescribed angle along the breakable line section; and connecting one end of one refrigerant flow pipe at the one part of the cooling fin block adjacent to the breakable line section with one end of another refrigerant flow pipe at the other part adjacent to the breakable line section.

BRIEF DESCRIPTION OF THE DRAWINGS

These and other objects and advantages of this invention will become apparent from the following detailed description of the presently preferred embodiments of the invention, taken in conjunction with the accompanying drawings of which.

DETAILED DESCRIPTION OF THE PREFERRED EMBODIMENTS

Preferred embodiments of the present invention will now be described with reference to accompanying drawings. However, same numerals are applied to similar elements throughout the accompanying drawings, and therefore the detailed descriptions thereof are not repeated.

Figure 1:
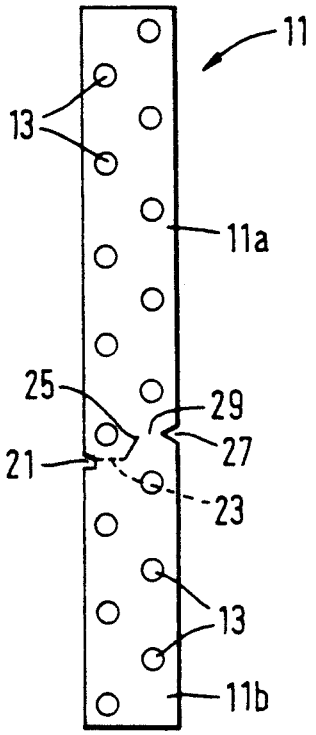
FIG. 1 is a side view illustrating a cooling fin of one embodiment of the present invention.
Figure 2:
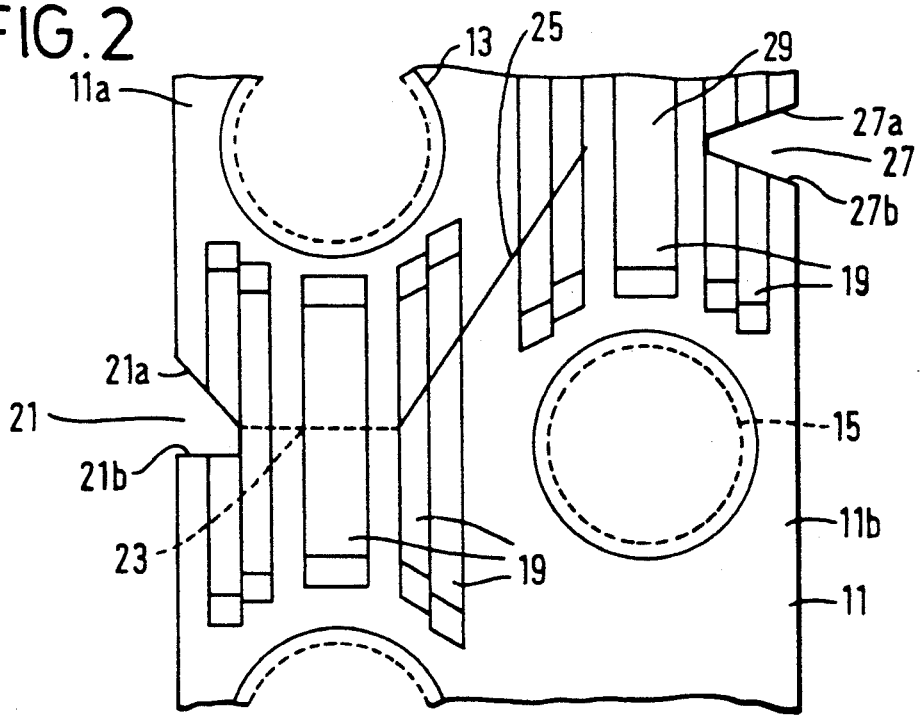
FIG. 2 is an enlarged segmentary side view of the cooling fin shown in FIG. 1.

As shown in FIGS. 1 and 2, a cooling fin 11 having a high heat conductively is preferably made of aluminum. Cooling fin 11 is formed in a thin elongated plate shape. A plurality of holes 13 are formed in the elongated plate in a zigzag state along the elongated direction. A prescribed number of such cooling fins are stacked one on another to make a cooling fin block 11*s*, and a refrigerant flow pipe 15 is inserted into each hole 13 of the stacked fins (hereinafter referred as a cooling fin block) 11*s* when a heat-exchanger 17 is made, as shown in FIG. 2. In FIG. 2, a plurality of slit fins 19 are formed in a portion of cooling fin 11 between holes 13 formed in cooling fin 11. Each slit fin 19 is formed by cutting and depressing the surface of cooling fin 11.

A first notch 21 is formed at one side of the middle portion of cooling fin 11 in the elongated direction. As clearly shown in FIG. 2, first notch 21 is formed in a substantially V-shape so that the upper side 21*a* of first notch 21 is declined and the lower side 21*b* of first notch 21 is leveled. A perforated line portion 23, acting as a breakable section, extends from the end of the upper side 21*a* of first notch 21 to the middle portion of cooling fin 21 in the width direction of cooling fin 11. The strength of perforated line portion 23 is designed so that it is broken when the upper part 11*a* of cooling fin 11 is bent against the lower part 11*b* of cooling fin 11 with a prescribed force in a direction indicated by a solid arrow A in FIG. 3. A previously cut line portion 25 extends from the end of perforated line portion 23 toward the other side of cooling fin 11 in the width direction so that it is inclined upward. A second notch 27 is formed at a portion of the other side of cooling fin 11 corresponding to the end of previously cut line 25 in the width direction. Second notch 27 is also formed in a V-shape so that upper and lower sides 27*a* and 27*b* of second notch 27 are inclined in an inverse relation to one the other. An uncut portion 29 is provided between the end of previously cut line 25 and second notch 27. Thus, upper part 11*a* of cooling fin 11 and lower part 11*b* are connected to one another through uncut portion 29. The above-described first and second notches 21 and 27, perforated line portion 23 and previously cut line portion 25 are formed in not only cooling fin 11 but also slit fins 19. In addition, first and second notches 21 and 27, perforated line portion 23 and previously cut line 25 are simultaneously formed when slit fins 19 are formed in cooling fin 11.

A manufacturing method for a heat-exchanger 17 in which upper part 11*a* of cooling fin block 11*s* is bent against lower part 11*b* thereof at a prescribed angle will be described.

Firstly, a prescribed number of the above-described cooling fins 11 in which first and second notches 21 and 27, perforated line portion 23, previously cut line 25, slit fins 19 and the plurality of holes 13 are previously formed are stacked to make a cooling fin block 11*s*. A refrigerant flow pipe 15 is inserted into each hole 13 and the ends of the adjacent pipes 15 in the elongated direction of cooling fin 11 are connected to one another by a U-shaped pipe 33, as shown in FIG. 3.

Figure 3:
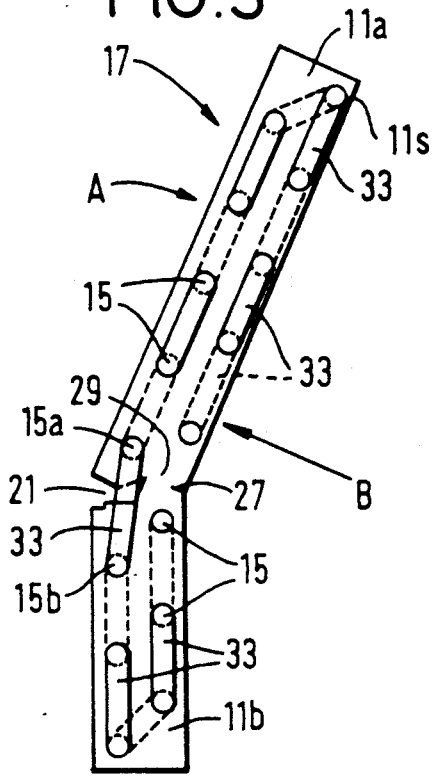
FIG. 3 is a side view of a heat-exchanger with a cooling fin block stacking a plurality of cooling fins shown in FIG. 1.

Secondly, the upper part 11*a* of the cooling fin block 11*s* is pushed in the direction indicated by a solid arrow A in FIG. 3. When the pushing pressure to the upper part 11*a* of cooling fin block 11*s* is increased and exceeds the prescribed value, perforated line portion 23 is broken and the upper part 11*a* of cooling fin block 11*s* is bent along the perforated line portion 23 and the previously cut line 25. When the pushing pressure is further increased, upper part 11*a* of cooling fin block 11*s* is further bent against the lower part 11*b* by deforming uncut portion 29 of cooling fin 11 joining upper part 11*a* and lower part 11*b* of cooling fin 11. Then, as shown in FIG. 3, refrigerant flow pipe 15*a* of upper part 11*a* adjacent to perforated line portion 23 and refrigerant flow pipe 15*b* of lower part 11*b* adjacent to perforated line portion 23 are connected with U-shaped pipe 33 to form heat-exchanger 17 in which upper part 11*a* of cooling fin block 11*s* is bent against lower part 11*b* of cooling fin block 11*s* at a prescribed angle.

Figure 4:
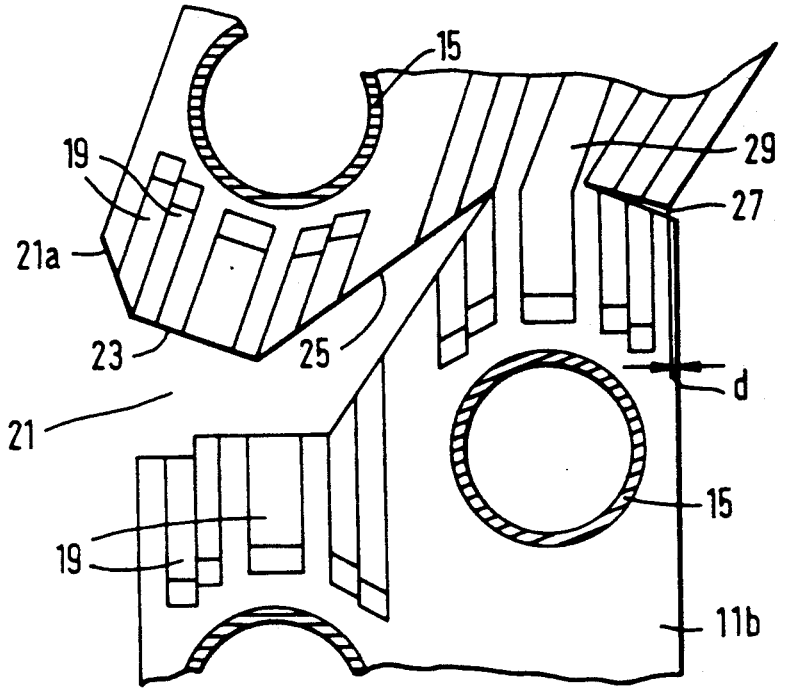
FIG. 4 is an enlarged segmentary side view of the heat-exchanger shown in FIG. 3.

In addition, upper part 11*a* of cooling fin block 11*s* is forced in a direction indicated by a solid arrow B in FIG. 3 (opposite to the direction of solid arrow A) when upper part 11*a* of cooling fin block 11*s* is bent in the direction indicated by solid arrow A. Upper part 11*a* of cooling fin block 11*s* is shifted in the direction of solid arrow B (width direction) and the edge of upper side 27*a* of second notch 27 is located at the inside of cooling fins 11 against the edge of lower side 27*b* of second notch 27 by a value d, as shown in FIG. 4. Therefore, since a drainage flowing down along upper part 11*a* of cooling fin block 11*s* easily comes down from the edge of upper side 27*a* of second notch 27 to lower part 11*b* of cooling fin block 11*s*, the drainage is smoothly collected.

With the above-described embodiment, since perforated line portion 23 which is broken by applying the prescribed pushing force is formed between first notch 21 and previously cut line 25, a cutting process to cooling fin block 11*s* is not required when upper part 11*a* of cooling fin block 11*s* is bent against lower part 11*b* of cooling fin block 11*s* and thus heat-exchanger 17 is assembled with fewer manufacturing processes, as compared with the conventional manufacturing method.

In the above-described embodiment, perforated line portion 23 and previously cut line portion 25 are arranged between first notch 21 and uncut portion 29. However, perforated line portion 23 may be extended to uncut portion 29, instead of previously cut line 25. In this case, since the breaking strength of perforated line 23 may be regulated by changing the interval of the perforation, upper part 11*a* of cooling fin block 11*s* is smoothly bent against lower part 11*b* of cooling fin block 11*s* even though the perforated line portion 23 is extended.

Figure 5:
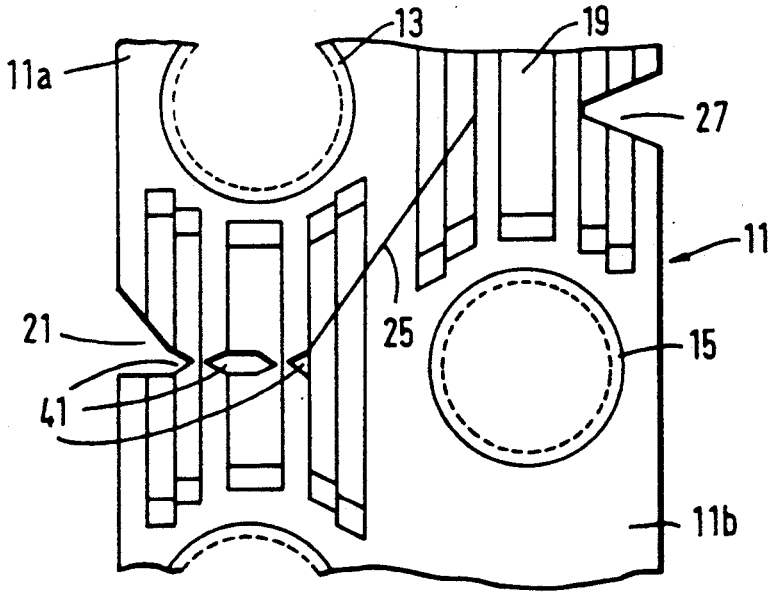
FIG. 5 is an enlarged segmentary side view of a second embodiment of the present invention.

A second embodiment of the present invention will be described with reference to FIG. 5. In this embodiment, a honeycomb shaped cut section 41 is formed in cooling fin 11, as a breakable section, instead of perforated line 23 described in the first embodiment. In this embodiment, a portion of cooling fin 11 between first notch 21 and previously cut lien 25 where honycomb shaped cut section 41 is formed is broken when upper part 11*a* of cooling fin block 11*s* is bent.

Figure 6:
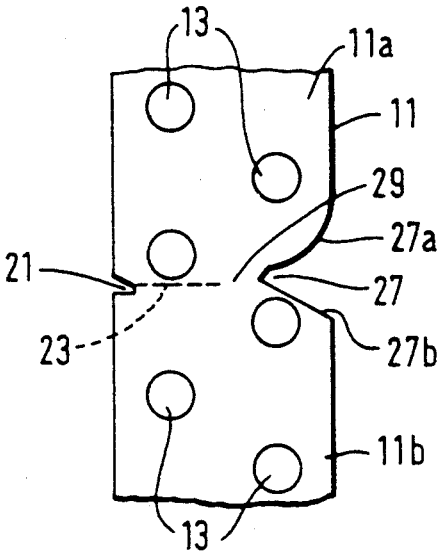
FIG. 6 is an enlarged segmentary side view of a third embodiment of the invention.

A third embodiment of the invention will now be described with reference to FIGS. 6 and 7. In this embodiment, upper side 27*a* of second notch 27 is formed in an arc-shape as shown in FIG. 6. The length of arc-shaped upper side 27*a* of second notch 27 is greater than the length of lower side 27*b* of second notch 27 which is a straight line. In addition, perforated line portion 23 is formed between first notch 21 and uncut portion 29 in a direction substantially perpendicular to the elongated direction of cooling fin 11.

Figure 7:
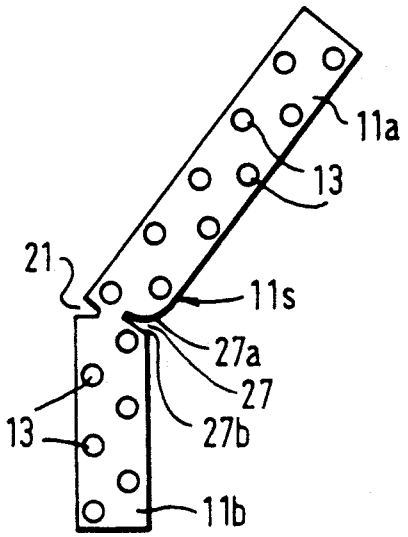
FIG. 7 is a side view of a heat-exchanger with a cooling fin block stacking a plurality of cooling fins shown in FIG. 6.

With the above-described arrangement, the lowermost portion of arc-shaped upper 27*a* of second notch 27 is located at a position corresponding to the middle portion of lower side 27*b* of second notch 27 when upper part 11*a* of cooling fin block 11*s* is bent, as shown in FIG. 7. Thus, the drainage smoothly flows from upper part 11*a* of cooling fin block 11*s* to lower part 11*b* through second notch 27.

Figure 8:
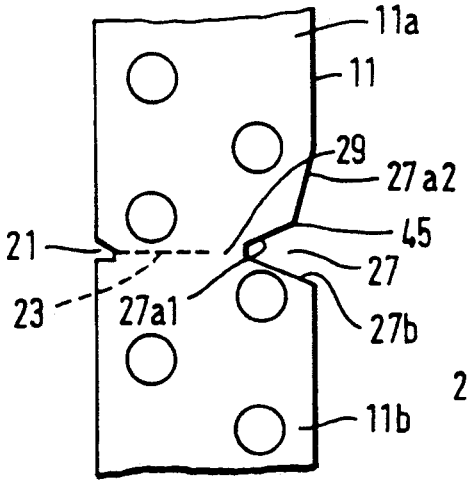
FIG. 8 is an enlarged segmentary side view of a fourth embodiment of the present invention.
Figure 9:
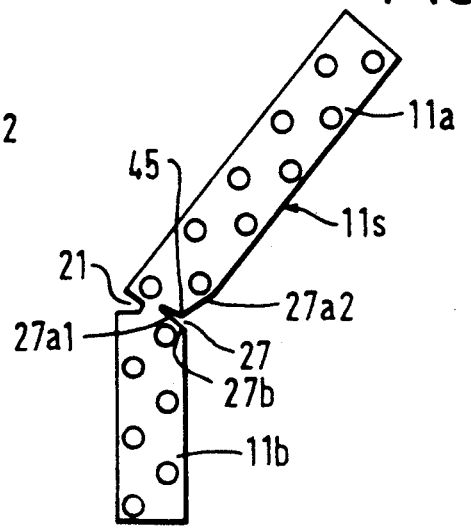
FIG. 9 is a side view of a heat-exchanger with a cooling fin block stacking a plurality of cooling fins shown in FIG. 8.

A fourth embodiment of the present invention will now be described with reference to FIGS. 8 and 9. In this embodiment, the configuration of upper side 27*a* of second notch 27 is different from that in the third embodiment shown in FIGS. 6 and 7. Upper side 27*a* of second notch 27 includes a first straight line portion 27*a*1, with a first inclination angle and a second straight line portion 27*a*2, connected to first straight line portion 27*a*2, with a second inclination angle greater than the first inclination angle. The total length of first and second straight line portions 27*a*1 and 27*a*2 is greater than the length of lower side 27*b* of second notch 27. As shown in FIG. 9, the connecting point 45 (edge portion) of first and second straight line portions 27*a*1and 27*a*2 is located at a position corresponding to the middle portion of lower side 27*b* of second notch 27 when upper part 11*a* of cooling fin block 11*s* is bent. Thus, a flow of drainage from upper part 11*a* of cooling fin block 11*s* to lower part 11*b* is smoothly performed through second notch 27.

In the above-described first to fourth embodiments, first notch 21 is formed in cooling fin 11 to easily bend upper part 11*a* of cooling fin block 11*s*. However, first notch 21 may not be formed to bend upper part 11*a* of cooling fin block 11*s*. It may be possible to bend upper part 11*a* of cooling fin block 11*s* by breaking the breakable section 23 or 41 of cooling fin block 11*s* without forming first notch 21.

In the present invention, the breakable section which is broken when upper part 11*a* of cooling fin block 11*s* is bent extends from one side of the cooling fin to the middle point in the width direction. Upper part 11*a* of cooling fin block 11*s* is bent by breaking the breakable section without executing a cutting process. Thus, a decrease in the manufacturing process of the heat-exchanger with bent cooling fin block is achieved.

The present invention has been described with respective to specific embodiments. However, other embodiments based on the principles of the present invention should be obvious to those of ordinary skill in the art. Such embodiments are intended to be covered by the claims.

What is claimed is:

1. A cooling fin used to a heat-exchanger comprising:

an elongated thin plate;

a plurality of holes in the plate;

a breakable line section extending from one side of the plate to a substantially middle portion of the plate in a direction perpendicular to the elongated direction of the plate, the breakable line section being broken when one part of the plate in the elongated direction is bent against the other part of the plate along the breakable line section; and a substantially V-shaped notch formed at a portion of the other side of the plate corresponding to an extended end of the breakable line section.

2. A fin according to claim 1, wherein the breakable line section includes a perforated line portion having a defined length from the one side of the plate.

3. A fin according to claim 2, wherein the breakable line section also includes a previously cut line portion which extends from the one end of the perforated line portion at an inclined angle in the direction perpendicular to the elongated direction.

4. A fin according to claim 1, wherein the breakable line section also includes a second substantially V-shaped notch formed at the one side of the plate so that one side of the notch declines and the other side of the notch is level.

5. A fin according to claim 4, wherein the breakable line section includes a perforated line portion extending from the second substantially V-shaped notch toward the other side of the plate in the direction perpendicular to the elongated direction of the plate.

6. A fin according to claim 5, wherein the breakable line section includes a previously cut line portion which extends from the one end of the perforated line portion at an inclined angle in the direction perpendicular to the elongated direction.

7. A fin according to claim 4, wherein the breakable line section includes a substantially honycomb-shaped hole connected to the second substantially V-shaped notch.

8. A fin according to claim 1, wherein the first substantially V-shaped notch has a lower side of a prescribed length and an upper side of a predetermined length greater than the lower side.

9. A fin according to claim 8, wherein the upper side of the first substantially V-shaped notch is formed in an arc shape sot hat a lower most point of the arc shaped upper side is located at a position corresponding to the middle portion of the lower side of the first substantially V-shaped notch when the fin is bent by breaking the breakable line section.

10. A fin according to claim 8, wherein the upper side of the first substantially V-shaped notch is formed with a first straight line extending at a first inclined angle and a second straight line extending from the extended end of the first straight line at a second inclined angle different from the first inclined angle so that the connecting point of the first and second straight lines is located at a position corresponding to the middle portion of the lower side of the first substantially V-shaped notch when the fin is bent by breaking the breakable line section.

11. A method for manufacturing a heat-exchanger having a bent cooling fin block including the steps of:

preparing cooling fin plates, each having a breakable line section extending from the side of the plate toward the other side of the plate in a direction perpendicular to an elongated direction, a substantially V-shaped notch formed at the other side of the plate and a plurality of holes;

stacking a prescribed number of the cooling fin plates to make a cooling fin block;

inserting refrigerant flow pipes into the cooling fin block through each of the plurality of holes;

breaking the breakable line section from one side of the cooling fin block and bending one part of the cooling fin block against the other part at a prescribed angle along the breakable line section; and connecting one end of one refrigerant flow pipe at the one part of the cooling fin block adjacent to the breakable line section with one end of another refrigerant flow pipe at the other part adjacent to the breakable line section.

12. A method according to claim 11, wherein the breaking step includes a step of pressing a portion of the other side of the one part of the cooling fin block in the vicinity of the substantially V-shaped notch toward the inside of the cooling fin block when the one part of the cooling fin block is bent.

* * * * *